United States Patent [19]

Lahti

[11] Patent Number: 4,606,252

[45] Date of Patent: Aug. 19, 1986

[54] CHAIN SAW WOOD CUTTING APPARATUS

[76] Inventor: Terry Lahti, R.R. 1, Box 98, Houghton, Mich. 49931

[21] Appl. No.: 496,512

[22] Filed: May 20, 1983

[51] Int. Cl.[4] ..... B27B 17/02

[52] U.S. Cl. ..... 83/574; 83/796; 83/798

[58] Field of Search ..... 83/574, 796, 798, 522

[56] References Cited

U.S. PATENT DOCUMENTS

| | | | |
|---|---|---|---|
| 3,134,409 | 5/1964 | Hayden | 83/522 X |
| 3,433,277 | 3/1969 | Ribley | 83/796 |
| 4,210,049 | 7/1980 | Gauthier | 83/796 |
| 4,214,498 | 7/1980 | Zukas | 83/796 |
| 4,215,612 | 8/1980 | Peel | 83/796 |
| 4,283,980 | 8/1981 | Jackson | 83/798 |
| 4,307,640 | 12/1981 | Michael | 83/796 X |
| 4,350,067 | 9/1982 | Picard | 83/796 |

*Primary Examiner*—Donald R. Schran

[57] ABSTRACT

The chain saw wood cutting apparatus disclosed is used for supporting a chain saw so that it may easily be swung by its handle between raised and lowered positions, for the purpose of cutting a log supported beneath into stove length sections.

5 Claims, 4 Drawing Figures

CHAIN SAW WOOD CUTTING APPARATUS

BACKGROUND OF INVENTION

This invention was designed to eliminate some of the back strain and unsafe work conditions commonly associated with cutting firewood with a chain saw. A common method of cutting firewood involves using a sawbuck, which is a wooden framework of three X's attached together, to hold the log off the ground to make it easier for a chain saw operator to cut the log into pieces. In this method, the saw operator would hold the saw with two hands while cutting through the log, which was held at about waist level by the sawbuck. The operator would cut off pieces of the log that extended from the sawbuck, then he would have to put the saw down to move the log over for another cut.

The last cut was the most dangerous, because the log was short by then, and the saw operator would frequently hold the log down with his foot to keep it from being kicked back by the chain saw as it was being cut.

This system has obvious short comings, such as the tireing and unsafe task of standing and operating a chain saw which may be deflected into a leg or foot of the operator if caution is not used.

This system could obviously benefit from some type of apparatus to support the saw, to eliminate lifting and holding the saw while loading the log or while cutting through it, and to prevent the saw from deflecting into the operator.

Other inventors have shared the same thought, but, because of design short comings, such as poor saw operating position, unnecessary complication, etc., none of their apparatus has gained widespread popularity.

It is, therefore, the predetermined purpose of this invention to solve the described problems in a new and better way.

SUMMARY OF INVENTION

The chain saw wood cutting apparatus serves two major functions, it holds the chain saw and it holds the log being cut.

The chain saw is held by clamping it to a moveable framework, that allows the saw to be raised and lowered for the purpose of cutting through the log.

The log is held at waist level by a "V" shaped trough, which is attached beneath the chain saw, so that the saw will cut perpendicular to the log center.

The saw support framework contains a spring that counter-balances the weight of the saw, so that the saw will stay in the raised position when not being used.

The saw support framework is designed to keep the saw parallel to the ground, as it is moved up and down.

This is unique, because all other patented designs rotate the saw at some point either ahead of the saw, behind the saw, or in the middle of the saw, as it cuts through the log.

To use the chain saw wood cutting apparatus, the operator would first clamp the chain saw into the saw supporting framework. The operator would then lift the log onto the trough, allowing it to overhang the amount to be cut off. Then, the saw could be started in the normal manner. While steadying the log with the left hand, the operator would guide the saw through the log by easily pressing down on the saw, and operating the throttle, with the right hand.

Once the cut was made, the saw would be returned to the raised position, where it would stay, idling, while the log would be moved over for the next cut.

A specially designed chain guard, which covers the chain bar when the saw is in the raised position, and which rotates out of the way when the saw is lowered, can be added for extra safety.

A specially designed cutoff length guide, which is adjustable, can also be added to help make each piece cut to the same length.

The wood cutting apparatus has many advantages over the sawbuck method. The chain saw is held by a spring loaded, moveable framework, which holds the saw at the ideal cutting angle to the log. This insures an accurate and easily controlled cutting operation which eliminates saw binding or pinching and the back strain associated with lifting the saw. Since the saw support framework restricts the lateral motion of the saw, the saw cannot kick back toward the operator, which makes starting and operating the saw much safer.

This apparatus has advantages over all other patented apparatus because the saw is always parallel to the ground, and does not tilt extremely when being raised or lowered. This keeps the saw in an ideal operating position at all times.

In conclusion, the wood cutting apparatus herein described makes the job of cutting firewood safer, easier, and more efficient.

DESCRIPTION OF THE PREFERRED EMBODIMENT

Figure 1:
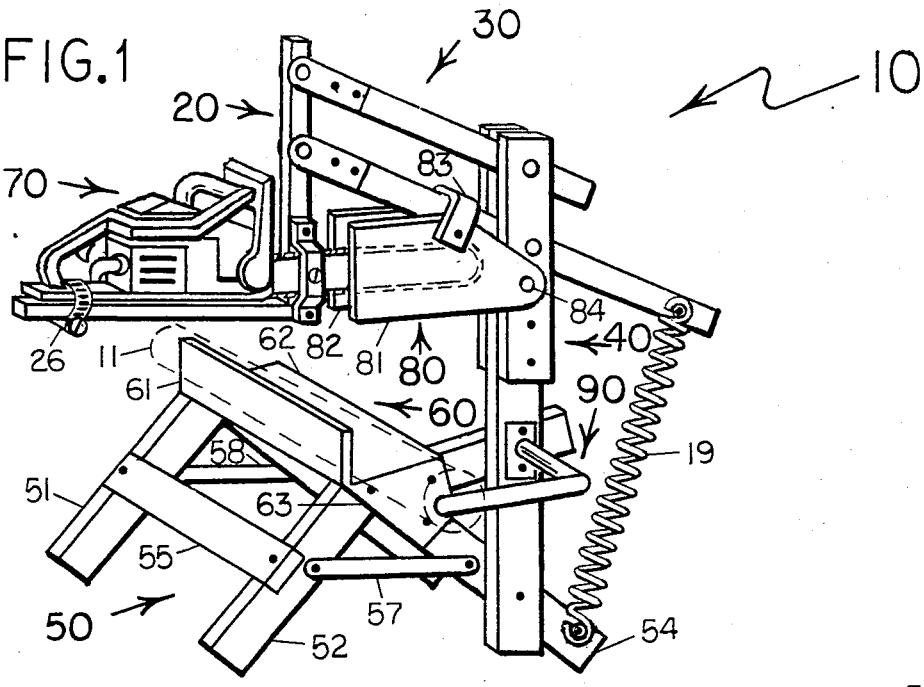
FIG. 1 A perspective view of the complete apparatus including the log to be cut, with the saw shown in the raised position.
Figure 2:
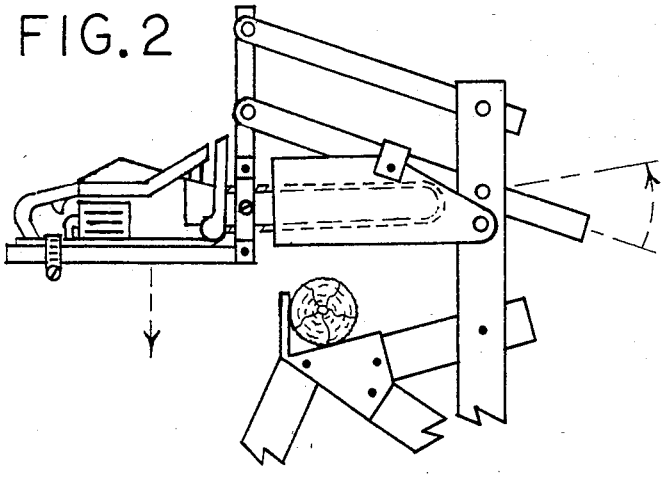
FIG. 2 An end view of the apparatus, clearly showing the relationship of the saw and log, and showing the chain guard covering the chain bar, with the saw in the raised position. (Spring, lower ends of legs, not shown)

The chain saw wood cutting apparatus 10 (FIG, 1) can be broken down into six major functioning components. They are the chain saw mounting assembly 20, the parallel link arm assembly 30, the vertical beam assembly 40, the leg assembly 50, the trough assembly 60, and the chain saw 70.

Figure 3:
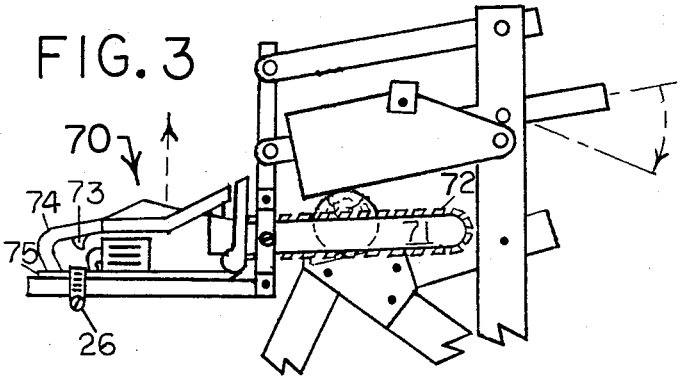
FIG. 3 An end view of the apparatus showing the saw in the lowered position with the chain guard resting on the log. (Spring, lower end of legs, not shown)

The chain saw 70 (FIG. 3) consists of the chain bar 71, chain 72, throttle 73, rear handle 74, and rear handle base 75.

Figure 4:
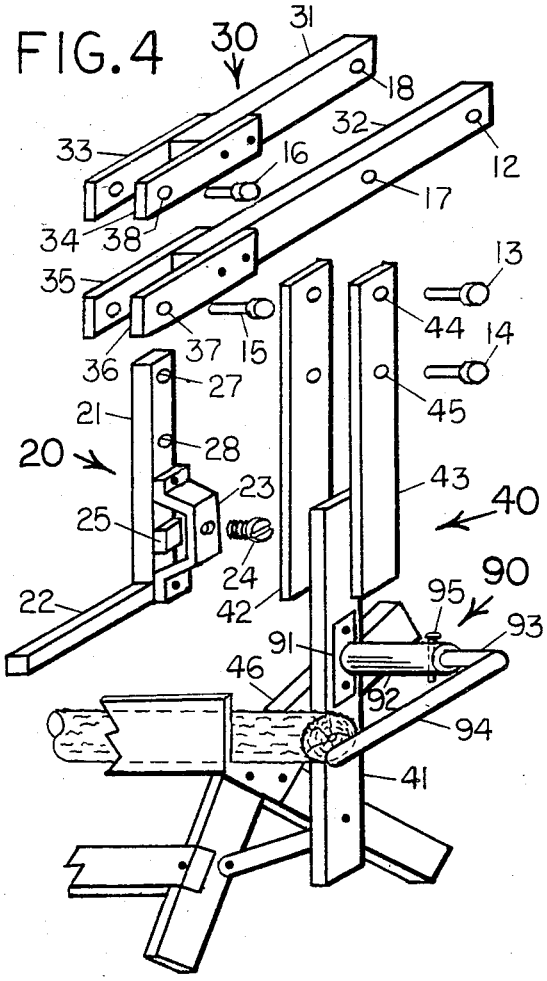
FIG. 4 An exploded perspective view of the apparatus showing the saw mounting assembly, parallel link arms, vertical beam, and cutoff length guide in detail. (Chain guard, left end of trough, left legs, not shown)

The chain saw mounting assembly 20 (FIG. 4) is responsible for clamping the chain saw 70 to the apparatus while providing two pivot holes 27 and 28, for attachment to the parallel link arms 31 and 32. The mounting assembly 20 is comprised of six parts, the vertical tube 21, the horizontal tube 22, the clamping strap 23, the clamping bolt 24, the chain clearance spacer 25, and the rear handle clamp 26. To clamp the saw to the assembly, the chain bar 71, would be inserted through the clamping strap 23, with one side of the bar resting against the chain clearance spacer 25, and the other facing the clamping bolt 24. The clamping bolt 24, which screws in on threads cut into the hole drilled into the clamping strap 23, would then be screwed down to clamp the chain bar 71 securely onto the assembly. For additional security, the rear handle clamp 26 would be placed around the saw's rear handle base 75 and the horizontal tube 22, and tightened, thus the saw would be very securely clamped to the apparatus.

The parallel link arm assembly 30 (FIG. 4) is comprised of the top link arm 31, and the lower link arm 32. Both upper and lower link arms each have two identical end plates 33,34,35, and 36 bolted in place at one end to provide holes for the attachment to the saw mounting assembly 20 by pivot pins 15 and 16. Both link arms have holes drilled perpendicular to their long axis at points of equal distance from the end plate pivot holes 37 and 38 respectively. These holes 17 and 18 are for pivotly attaching the arms 31 and 32 to the vertical beam 40 by pins 13 and 14. The lower link arm 32, extends beyond pivot hole 17 for the purpose of providing a lever arm for the attachment of the counter balancing spring 19 by a pin through hole 17. This leverage distance can be varied to adjust the spring tension to the weight of the saw.

The vertical beam assembly 40 (FIG. 4) is responsible for attaching the parallel link arm assembly 30 to the leg framework 50. The beam assembly 40 is comprised of a main beam 41, which has two identical pivot plates 42 and 43 which are bolted to its upper end to provide pivot holes 44 and 45, for pins 13 and 14 for attachment of the parallel arm assembly 30. The bottom of the beam 41 is attached to the leg 54, while a beam support 46 is bolted to its middle to attach the vertical beam 41 to the trough end flap 63.

Noted that the distance of hole 27 and 28 on the mounting assembly 20 is equal to the distance between holes 44 and 45 on the vertical beam assembly 40, which when combined with the equal pivot arm length on the parallel link arms 31 and 32 forms a parallelogram, which has opposite sides of equal length, and which pivots on its corners. This is the geometic configuration that gives the apparatus its unique straight up and down saw movement.

The trough assembly 60 (FIG. 1) could be made from a properly shaped piece of sheet metal by forming the angle between the vertical wall 61, and the trough floor 62. Two identical, but mirror image flaps 63 and 64 (64 not shown) are bent down perpendicular to the trough floor 62. These flaps provide for the attachment to the leg assembly 50.

The leg assembly 50 (FIG. 1) consists of four legs 51, 52, 53 and 54 with their upper ends bolted to the trough flaps 63 and 64, and with opposite legs 51 and 52 connected by a cross brace 55 (same for legs 53 and 54 although cross brace 54 not shown). Legs 51 and 53 are connected by a flat strap 57 to hold the trough at waist level (same for legs 52 and 54 with strap 58).

Also included for added safety and efficiency are a saw chain guard 80, and a cutoff length guide 90.

The chain guard 80 (FIG. 1) is made of a right side plate 81 and a left side plate 82 one located on each side of the chain bar 71 with both sides attached together by an inverted "U" shaped strap 83 that goes over the top of the lower link arm 32. Each side plate 81 and 82 pivots on a common mounting pin 84 which passes completely through the vertical beam 40.

When in the raised position, the strap 83 rest against the upper surface of the arm 32, and then holds the guard 80 in the proper place respective to the chain bar. When the saw is lowered as to cut through a log, the guard 80 rotates down until it comes in contact with the upper surface of the log and stays there as the saw cuts through.

The cut off length guide 90 (FIG. 4) consists of a mounting base 91 to which a larger pipe 92 is welded. A smaller pipe 93, is welded to the leg stop 94.

The large pipe 92 and smaller pipe 93 are sized to slide inside each other to provide for cutoff length adjustment, with the smaller pipe having a series of holes drilled for locating the pin 95 at different lengths to hold the log stop 94 at different distances from the edge of the trough.

To operate the apparatus 10 (FIG. 1) the operator would first start the saw in the normal manner, and while the saw sat idling in the raised position, the operator would lift a log W onto the trough 60 being careful to lift the log W stick out from the edge of the trough the amount to be cut off, which can be determined by sliding the log out until it touches the log stop 94.

The operator would then push down on the rear saw handle 74 with his right hand until the chain 72 came in contact with the upper surface of the log W. Then while steadying the log with his left hand, and while continuing to push down on the saw and operating the throttle at the same time, with the right hand, the operator would feed the saw through the log until a length falls off. He would then return the saw to the up position, where it would stay idling while he would move the log over for another cut. Then he would start the process over.

It should be understood then, that the described chain saw wood cutting apparatus provides a relatively simple method of converting an ordinarily dangerous to operate chain saw into a wood cutting machine that is safe and efficient to operate.

A single person is able to operate the equipment since only one hand is necessary to raise and lower the saw, while the other hand is free to steady the log being cut.

The safety of this wood cutting machine is very good because the chain saw does not require any modification, and all standard throttle linkages and safety features are fully operational.

The end result being that with the use of the above described apparatus, more people both younger, older, and more disabled can be able to cut their own firewood.

While the disclosed invention has been described with respect to a specific embodiment, it is appreciated that those skilled in the art can produce variations of specific parts, without changing the basic function of the apparatus.

What I claim and desire to secure by Letters Patent of the United States is:

1. A chain saw wood cutting apparatus comprising:

a chain saw mounting assembly, said assembly consisting of a vertical member and a horizontal member, said vertical member being attached ridgidly at its lower end to one end of the horizontal member, the horizontal member's long axis substantially perpendicular to the vertical member's long axis, the resulting assembly resembling a backward "L" shape;

the means to clamp the chain saw securely to the chain saw mounting assembly, the chain saw resting along the assembly's horizontal member, the chain saw's cutting bar projecting out past the junction of vertical member and the horizontal member, the long axis of the chain saw's cutting bar being roughly perpendicular to the long axis of the assembly's vertical member;

an upper link arm and a lower link arm, both link arms each having pivot attachment holes at both ends, both link arms having equal distances between said pivot attachment holes;

two pivot attachment holes, located in the upper part of the vertical member of the chain saw mounting assembly, used for attaching the upper link arm and the lower link arm to the chain saw mounting assembly, said pivotally attached link arms extending out and away from the chian saw in roughly the same direction as the chain saw's cutting bar;

a vertical beam assembly containing two separate pivot attachment holes, located in it's upper end; said pivot attachment holes being the same distance apart as the similiar attachment holes located in the vertical member of the chain saw mounting assembly;

said pivot attachment holes, in the vertical beam assembly, used for pivotally attaching the upper and lower link arms to the vertical beam assembly, said link arms being attached at their other ends to the chain saw mounting assembly;

a leg assembly, which supports the vertical beam assembly, and also contains the means to support the log in the proper relationship to the chain saw;

whereby the exact geometric relationship between the chain saw mounting assembly, the upper and lower link arms, and the vertical beam assembly causes the chain saw to move through a controlled and infinately repeatable path, and that the motion that the saw travels through is translational relative to any horizontal plane as the saw is raised and lowered for the purpose of cutting through the log supported beneath.

2. The chain saw wood cutting apparatus of claim 1, wherein the lower link arm extends beyond the vertical beam assembly for the purpose of creating a lever arm for the attachment of a spring.

3. The chain saw wood cutting apparatus of claim 1, wherein the upper link arm extends beyond the vertical beam assembly, thereby creating a lever arm where a spring could be attached.

4. The chain saw wood cutting apparatus of claim 1, wherein the lower link arm extends beyond the vertical beam assembly, thus creating a lever arm, this arm having a series of holes to provide adjustable tension for a spring.

5. The chain saw wood cutting apparatus of claim 1, wherein the upper link arm extends beyond the vertical beam assembly, thus creating a lever arm, said lever arm containing a series of holes to provide adjustability for a spring.

* * * * *